US011735846B2

(12) United States Patent
Phillips et al.

(10) Patent No.: US 11,735,846 B2
(45) Date of Patent: Aug. 22, 2023

(54) STACKED CARD EDGE CONNECTOR HAVING INNER CONTACT ASSEMBLY AND OUTER CONTACT ASSEMBLY

(71) Applicant: TE Connectivity Services GmbH, Schaffhausen (CH)

(72) Inventors: Michael John Phillips, Camp Hill, PA (US); Michael Eugene Shirk, Grantville, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 70 days.

(21) Appl. No.: 17/384,210

(22) Filed: Jul. 23, 2021

(65) Prior Publication Data

US 2023/0025650 A1 Jan. 26, 2023

(51) Int. Cl.
*H01R 12/72* (2011.01)
*H01R 13/514* (2006.01)

(52) U.S. Cl.
CPC ..... *H01R 12/721* (2013.01); *H01R 13/514* (2013.01)

(58) Field of Classification Search
CPC ..... H01R 12/721; H01R 13/514
USPC ..... 439/631
See application file for complete search history.

(56) References Cited

U.S. PATENT DOCUMENTS 6,565,387 B2 5/2003 Cohen
9,065,230 B2 * 6/2015 Milbrand, Jr. ..... H01R 12/7005
10,069,262 B2 * 9/2018 Little ..... H01R 27/00
10,403,565 B1 * 9/2019 Henry ..... H01R 13/6596
10,530,081 B1 * 1/2020 Costello ..... H01R 12/721
10,530,100 B1 1/2020 Henry et al.
10,855,020 B1 * 12/2020 Phillips ..... H01R 12/721
10,944,189 B2 * 3/2021 Xu ..... H01R 12/75
2006/0166551 A1 * 7/2006 Korsunsky ..... H01R 12/727 439/541
2012/0077380 A1 * 3/2012 Minich ..... H01R 13/6589 439/607.05
2012/0225585 A1 * 9/2012 Lee ..... H01R 13/6474 439/626
2017/0324202 A1 * 11/2017 Little ..... H01R 12/724
2018/0115119 A1 * 4/2018 Little ..... H01R 12/00
2019/0293884 A1 * 9/2019 Little ..... G02B 6/3897
2020/0235529 A1 * 7/2020 Kirk ..... H01R 13/6585
2020/0274267 A1 * 8/2020 Zerebilov ..... H01R 13/6581

FOREIGN PATENT DOCUMENTS

CN 101699665 A * 4/2010 ..... G02B 6/0001
CN 102222840 A * 10/2011 ..... H01R 12/724
CN 208889900 U 5/2019
CN 211719825 U 10/2020
WO WO-2011060236 A1 * 5/2011 ..... H01R 12/721
WO WO-2011140438 A2 * 11/2011 ..... H01R 12/00

* cited by examiner

*Primary Examiner* — Peter G Leigh

(57) ABSTRACT

A stacked card edge connector for mating with stacked pluggable modules includes a housing configured to be mounted to a host circuit board and including inner and outer contact channels and inner and outer card slots configured to receive card edges of module circuit boards of the stacked pluggable modules. The stacked card edge connector includes an inner contact assembly received in the inner card slot and an outer contact assembly received in the outer card slot.

22 Claims, 7 Drawing Sheets

STACKED CARD EDGE CONNECTOR HAVING INNER CONTACT ASSEMBLY AND OUTER CONTACT ASSEMBLY

BACKGROUND OF THE INVENTION

The subject matter herein relates generally to card edge connectors of communication systems.

Some communication systems utilize communication connectors, such as card edge connectors to interconnect various components of the system for data communication. Some known communication systems use pluggable modules, such as I/O modules or circuit cards, which are electrically connected to the card edge connectors. The pluggable modules have module circuit boards having card edges that are mated with the card edge connectors during the mating operation. Each card edge connector typically has an upper row of contacts and a lower row of contact for mating with the corresponding circuit board. There is a need for connectors and circuit boards of communication systems to have greater contact density and/or data throughput. Known card edge connectors are not without disadvantages. For instance, large sections of the contacts are typically rigidly fixed within the connector housing, such as using a contact overmold to hold the contacts relative to each other and relative to the housing. The overmold may negatively affect the electrical characteristics of the signal transmission lines. Properly shielding the signal transmission lines is problematic. Additionally, properly positioning the mating ends and the terminating ends of all of the contacts is difficult to control.

A need remains for a reliable card edge connector.

BRIEF DESCRIPTION OF THE INVENTION

In one embodiment, a stacked card edge connector for mating with stacked pluggable modules is provided. The stacked card edge connector includes a housing having a top and a bottom. The housing has a front and a rear. The housing has a first side and a second side. The bottom is configured to be mounted to a host circuit board. The housing includes a cavity at the rear. The housing includes an inner contact channel and an outer contact channel. The inner contact channel is closer to the bottom and the host circuit board. The housing includes an inner card slot open to the inner contact channel at the front of the housing. The housing includes an outer card slot open to the outer contact channel at the front of the housing. The inner and outer card slots are configured to receive card edges of module circuit boards of the stacked pluggable modules. The stacked card edge connector includes an inner contact assembly received in the cavity. The inner contact assembly has an inner contact positioner holding inner contacts in an upper contact array and a lower contact array. The inner contact positioner has an upper wall and a lower wall with an inner positioner card slot defined therebetween. The upper wall supports the upper contact array of the inner contact assembly. The lower wall supports the lower contact array of the inner contact array. The inner contact positioner is positioned in the inner contact channel aligned with the inner card slot to receive the card edge of the module circuit board. The inner contact positioner includes an inner locating feature engaging the housing to position the inner contacts relative to the housing for electrical connection with the host circuit board and the corresponding pluggable module. The stacked card edge connector includes an outer contact assembly received in the cavity. The outer contact assembly has an outer contact positioner holding outer contacts in an upper contact array and a lower contact array. The outer contact positioner has an upper wall and a lower wall with an outer positioner card slot defined therebetween. The upper wall supports the upper contact array of the outer contact assembly. The lower wall supports the lower contact array of the outer contact array. The outer contact positioner is positioned in the outer contact channel aligned with the outer card slot to receive the card edge of the module circuit board. The outer contact positioner includes an outer locating feature engaging the housing to position the outer contacts relative to the housing for electrical connection with the host circuit board and the corresponding pluggable module.

In another embodiment, a stacked card edge connector for mating with stacked pluggable modules is provided. The stacked card edge connector includes a housing having a top and a bottom. The housing has a front and a rear. The housing has a first side and a second side. The bottom is configured to be mounted to a host circuit board. The housing includes a cavity at the rear. The housing includes inner housing locating features proximate to the bottom and housing locating features proximate to the top. The housing includes an inner contact channel and an outer contact channel. The inner contact channel is closer to the bottom and the host circuit board. The housing includes an inner card slot open to the inner contact channel at the front of the housing. The housing includes an outer card slot open to the outer contact channel at the front of the housing. The inner and outer card slots configured to receive card edges of module circuit boards of the stacked pluggable modules. The stacked card edge connector includes an inner contact assembly received in the cavity. The inner contact assembly has an inner contact positioner holding inner contacts in an upper contact array and a lower contact array. The upper contact array includes a front contact holder holding corresponding inner contacts and a rear contact holder holding corresponding inner contacts. The lower contact array includes a front contact holder holding corresponding inner contacts and a rear contact holder holding corresponding inner contacts. The inner contact positioner has an upper wall and a lower wall extending between side walls of the inner contact positioner. The inner contact positioner includes an inner positioner card slot defined between the upper wall and the lower wall of the inner contact positioner. The upper wall supports the upper contact array of the inner contact assembly. The lower wall supports the lower contact array of the inner contact array. The inner contact positioner is positioned in the inner contact channel aligned with the inner card slot to receive the card edge of the module circuit board. The side walls includes front slots and rear slots. The front slots receiving the front contact holder to position the inner contacts relative to the inner contact positioner. The rear slots receiving the rear contact holder to position the inner contacts relative to the inner contact positioner. The inner contact positioner includes an inner locating feature engaging the inner housing locating features to position the inner contacts relative to the housing for electrical connection with the host circuit board and the corresponding pluggable module. The stacked card edge connector includes an outer contact assembly received in the cavity. The outer contact assembly has an outer contact positioner holding outer contacts in an upper contact array and a lower contact array. The upper contact array includes a front contact holder holding corresponding outer contacts and a rear contact holder holding corresponding outer contacts. The lower contact array includes a front contact holder holding corresponding outer contacts and a rear contact holder holding corresponding outer contacts. The outer contact positioner has an upper wall and a lower wall extending between side walls of the outer contact positioner. The outer contact positioner includes an outer positioner card slot defined between the upper wall and the lower wall of the outer contact positioner. The upper wall supports the upper contact array of the outer contact assembly. The lower wall supports the lower contact array of the outer contact array. The outer contact positioner is positioned in the outer contact channel aligned with the outer card slot to receive the card edge of the module circuit board. The side walls includes front slots and rear slots. The front slots receiving the front contact holder to position the outer contacts relative to the outer contact positioner. The rear slots receiving the rear contact holder to position the outer contacts relative to the outer contact positioner. The outer contact positioner includes an outer locating feature engaging the housing locating features to position the outer contacts relative to the housing for electrical connection with the host circuit board and the corresponding pluggable module.

In a further embodiment, a stacked card edge connector for mating with stacked pluggable modules is provided. The stacked card edge connector includes a housing having a top and a bottom. The housing has a front and a rear. The housing has a first side and a second side. The bottom is configured to be mounted to a host circuit board. The housing includes a cavity at the rear. The housing includes an inner contact channel and an outer contact channel. The inner contact channel is closer to the bottom and the host circuit board. The housing includes an inner card slot open to the inner contact channel at the front of the housing. The housing includes an outer card slot open to the outer contact channel at the front of the housing. The inner and outer card slots configured to receive card edges of module circuit boards of the stacked pluggable modules. The stacked card edge connector includes an inner contact assembly received in the cavity. The inner contact assembly has an inner contact positioner holding inner contacts in an upper contact array and a lower contact array. The inner contact positioner has an upper wall and a lower wall with an inner positioner card slot defined therebetween. The upper wall supports the upper contact array of the inner contact assembly. The lower wall supports the lower contact array of the inner contact array. The inner contact positioner is positioned in the inner contact channel aligned with the inner card slot to receive the card edge of the module circuit board. The inner contact positioner includes an inner locating feature engaging the housing to position the inner contacts relative to the housing for electrical connection with the host circuit board and the corresponding pluggable module. The stacked card edge connector includes an outer contact assembly received in the cavity. The outer contact assembly has an outer contact positioner holding outer contacts. The outer contacts includes upper contacts in an upper contact array and lower contacts in a lower contact array. The outer contact positioner has an upper wall and a lower wall with an outer positioner card slot defined therebetween. The upper wall supports the upper contact array of the outer contact assembly. The lower wall supports the lower contact array of the outer contact array. The outer contact positioner is positioned in the outer contact channel aligned with the outer card slot to receive the card edge of the module circuit board. The outer contact positioner includes an outer locating feature engaging the housing to position the outer contacts relative to the housing for electrical connection with the host circuit board and the corresponding pluggable module. The upper contacts include upper intermediate portions extending between upper mating beams and upper contact tails. The upper mating beams extending into the outer positioner card slot. The upper contact tails extending from the outer contact positioner for mounting to the host circuit board. The upper contact array includes an upper front contact holder holding the upper mating beams. The upper contact array includes an upper rear contact holder separate and discrete from the upper front contact holder holding the upper contact tails. The upper contact array includes an upper intermediate contact holder separate and discrete from the upper front and rear contact holders holding the upper intermediate portions. The lower contacts include lower intermediate portions extending between lower mating beams and lower contact tails. The lower mating beams extending into the outer positioner card slot. The lower contact tails extending from the outer contact positioner for mounting to the host circuit board. The lower contact array includes a lower front contact holder holding the lower mating beams and a lower rear contact holder separate and discrete from the lower front contact holder holding the lower contact tails. The lower contact array includes a lower intermediate contact holder separate and discrete from the lower front and rear contact holders holding the lower intermediate portions.

DETAILED DESCRIPTION OF THE INVENTION

Figure 1:
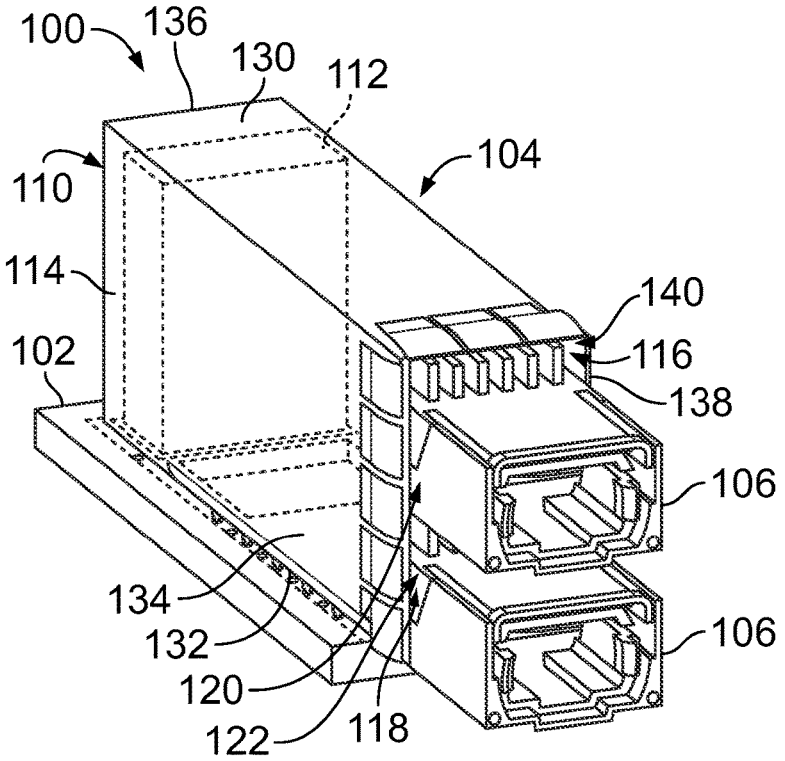
FIG. 1 is a front perspective view of communication system formed in accordance with an exemplary embodiment.

FIG. 1 is a front perspective view of communication system 100 formed in accordance with an exemplary embodiment. The communication system 100 includes a circuit board 102 and a receptacle connector assembly 104 mounted to the circuit board 102. Pluggable modules 106 are configured to be electrically connected to the receptacle connector assembly 104. The pluggable modules 106 are electrically connected to the circuit board 102 through the receptacle connector assembly 104.

In an exemplary embodiment, the receptacle connector assembly 104 includes a receptacle cage 110 and an electrical connector assembly 112 (shown in phantom) adjacent the receptacle cage 110. For example, in the illustrated embodiment, the electrical connector assembly 112 is received in the receptacle cage 110. In other various embodiments, the electrical connector assembly 112 may be located rearward of the receptacle cage 110. In various embodiments, the receptacle cage 110 is enclosed and provides electrical shielding for the electrical connector assembly 112. The pluggable modules 106 are loaded into the receptacle cage 110 and are at least partially surrounded by the receptacle cage 110. The receptacle cage 110 includes a plurality of walls 114 that define one or more module channels for receipt of corresponding pluggable modules 106. The walls 114 may be walls defined by solid sheets, perforated walls to allow airflow therethrough, walls with cutouts, such as for a heatsink or heat spreader to pass therethrough, or walls defined by rails or beams with relatively large openings, such as for airflow therethrough. In an exemplary embodiment, the receptacle cage 110 is a shielding, stamped and formed metallic cage member with the walls 114 being shielding walls 114. In other embodiments, the receptacle cage 110 may be open between frame members, such as rails or beams, to provide cooling airflow for the pluggable modules 106 with the frame members of the receptacle cage 110 defining guide tracks for guiding loading of the pluggable modules 106 into the receptacle cage 110.

In the illustrated embodiment, the receptacle cage 110 constitutes a stacked cage member having an upper module channel 116 and a lower module channel 118. The upper module channel 116 is located outward of (further from the host circuit board 102) the lower module channel 118. The lower module channel 118 is located inward of (closer to the host circuit board 102) the upper module channel 116. The receptacle cage 110 has upper and lower module ports 120, 122 that open to the module channels 116, 118 that receive the pluggable modules 106. Any number of module channels may be provided in various embodiments. In the illustrated embodiment, the receptacle cage 110 includes the upper and lower module channels 116, 118 arranged in a single column, however, the receptacle cage 110 may include multiple columns of ganged module channels 116, 118 in alternative embodiments (for example, 2×2, 3×2, 4×2, 4×3, etc.). The receptacle connector assembly 104 is configured to mate with the pluggable modules 106 in both stacked module channels 116, 118. Optionally, multiple electrical connector assemblies 112 may be arranged within the receptacle cage 110, such as when multiple columns of module channels 116, 118 are provided.

In an exemplary embodiment, the walls 114 of the receptacle cage 110 include a top wall 130, a bottom wall 132, and side walls 134 extending between the top wall 130 and the bottom wall 132. The bottom wall 132 may rest on the circuit board 102. However, in alternative embodiments, the bottom wall 132 may be elevated a distance above the circuit board 102 defining a gap below the bottom wall 132, such as for airflow. In other various embodiments, the receptacle cage 110 may be provided without the bottom wall 132. Optionally, the walls 114 of the receptacle cage 110 may include a rear wall 136 and a front wall 138 at the front of the receptacle cage 110. The module ports 120, 122 are provided in the front wall 138. The walls 114 define a cavity 140. For example, the cavity 140 may be defined by the top wall 130, the bottom wall 132, the side walls 134, the rear wall 136 and the front wall 138.

In an exemplary embodiment, other walls 114 may separate or divide the cavity 140 into the various module channels 116, 118. For example, the walls 114 may include a channel separator between the upper and lower module channels 116, 118. The channel separator may form a space between the upper and lower module channels 116, 118, such as for airflow, for a heat sink, for routing light pipes, or for other purposes. For example, the channel separator includes an upper panel, a lower panel and a front panel between the upper and lower panels. In other various embodiments, the walls 114 may include a divider walls extending between the top wall 130 and the bottom wall 132 to separate ganged module channels from each other. The divider walls are parallel to the side walls 134.

In an exemplary embodiment, the receptacle cage 110 may include one or more gaskets at the front wall 138 for providing electrical shielding for the module channels 116, 118. For example, the gaskets may be configured to electrically connect with the pluggable modules 106 received in the corresponding module channels 116, 118. The gaskets may be configured to electrically connect to a panel or bezel.

In an exemplary embodiment, the receptacle connector assembly 104 may include one or more heat sinks for dissipating heat from the pluggable modules 106. For example, the heat sink may be coupled to the top wall 130 for engaging the upper pluggable module 106 received in the upper module channel 116. The heat sink may extend through an opening in the top wall 130 to directly engage the pluggable module 106. Other types of heat sinks may be provided in alternative embodiments.

In an exemplary embodiment, the electrical connector assembly 112 is received in the cavity 140, such as proximate to the rear wall 136. However, in alternative embodiments, the electrical connector assembly 112 may be located behind the rear wall 136 exterior of the receptacle cage 110 and extend into the cavity 140 to interface with the pluggable module(s) 106. In an exemplary embodiment, a single electrical connector assembly 112 is used to electrically connect with the pair of stacked pluggable modules 106 in the upper and lower module channels 116, 118.

In an exemplary embodiment, the pluggable modules 106 are loaded through the front wall 138 to mate with the electrical connector assembly 112. The shielding walls 114 of the receptacle cage 110 provide electrical shielding around the electrical connector assembly 112 and the pluggable modules 106, such as around the mating interfaces between the electrical connector assembly 112 and the pluggable modules 106.

Figure 2:
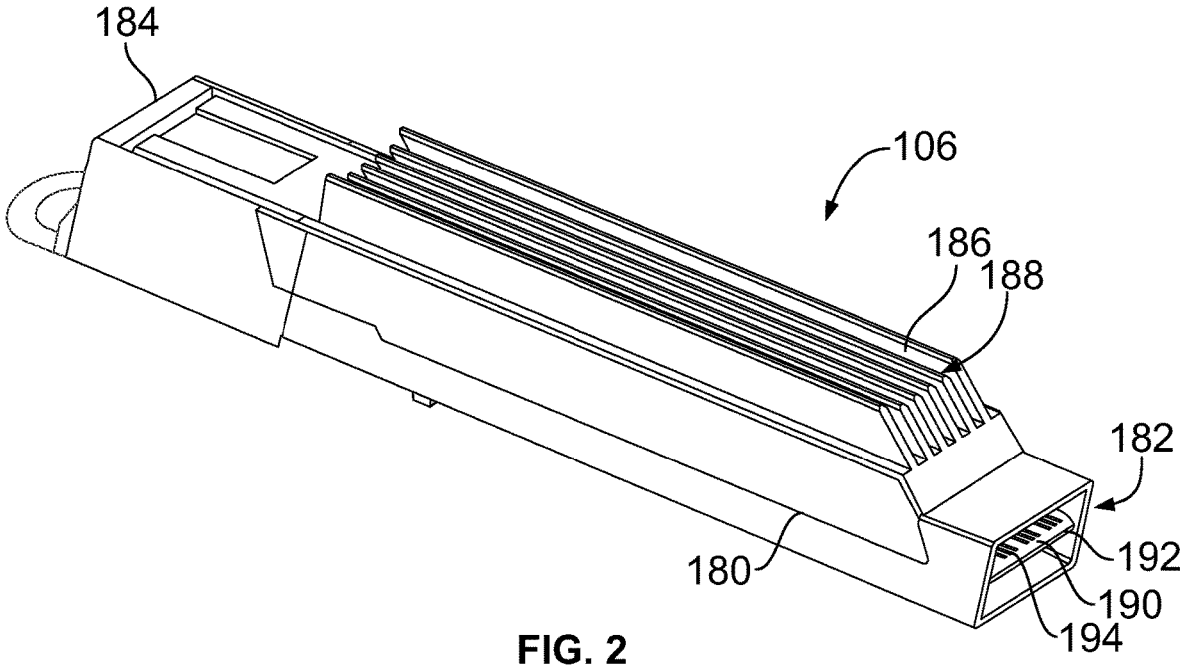
FIG. 2 is a rear perspective view of the pluggable module in accordance with an exemplary embodiment.

FIG. 2 is a rear perspective view of the pluggable module 106 in accordance with an exemplary embodiment. The pluggable module 106 has a pluggable body 180, which may be defined by one or more shells. The pluggable body may be thermally conductive and/or may be electrically conductive, such as to provide EMI shielding for the pluggable module 106. The pluggable body 180 includes a mating end 182 and an opposite front end 184. The mating end 182 is configured to be inserted into the corresponding module channel 116 or 118 (shown in FIG. 1). The front end 184 may be a cable end having a cable extending therefrom to another component within the system.

The pluggable module 106 includes a module circuit board 190 that is configured to be communicatively coupled to the electrical connector assembly 112 (shown in FIG. 1). The module circuit board 190 may be accessible at the mating end 182. The module circuit board 190 has a card edge 192 extending between a first or upper surface and a second or lower surface at a mating end of the module circuit board 190. The module circuit board 190 includes mating contacts 194, such as pads or circuits, at the card edge 192 configured to be mated with the card edge connector 112. In an exemplary embodiment, the mating contacts 194 are provided on the upper surface and the lower surface. The module circuit board 190 may include components, circuits and the like used for operating and or using the pluggable module 106. For example, the module circuit board 190 may have conductors, traces, pads, electronics, sensors, controllers, switches, inputs, outputs, and the like associated with the module circuit board 190, which may be mounted to the module circuit board 190, to form various circuits.

In other various embodiments, the pluggable module 106 may be a circuit card rather than an I/O module. For example, the pluggable module 106 may include the module circuit board 190 without the pluggable body 180 surrounding the module circuit board 190.

In an exemplary embodiment, the pluggable body 180 provides heat transfer for the module circuit board 190, such as for the electronic components on the module circuit board 190. For example, the module circuit board 190 is in thermal communication with the pluggable body 180 and the pluggable body 180 transfers heat from the module circuit board 190. In an exemplary embodiment, the pluggable body 180 includes a plurality of heat transfer fins 186 along at least a portion of the outer perimeter of the pluggable module 106. The fins 186 transfer heat away from the main shell of the pluggable body 180, and thus from the module circuit board 190 and associated components. The fins 186 are separated by gaps 188 that allow airflow or other cooling flow along the surfaces of the fins 186 to dissipate the heat therefrom. In the illustrated embodiment, the fins 186 are parallel plates that extend lengthwise; however the fins 186 may have other shapes in alternative embodiments, such as cylindrical or other shaped posts.

Figure 3:
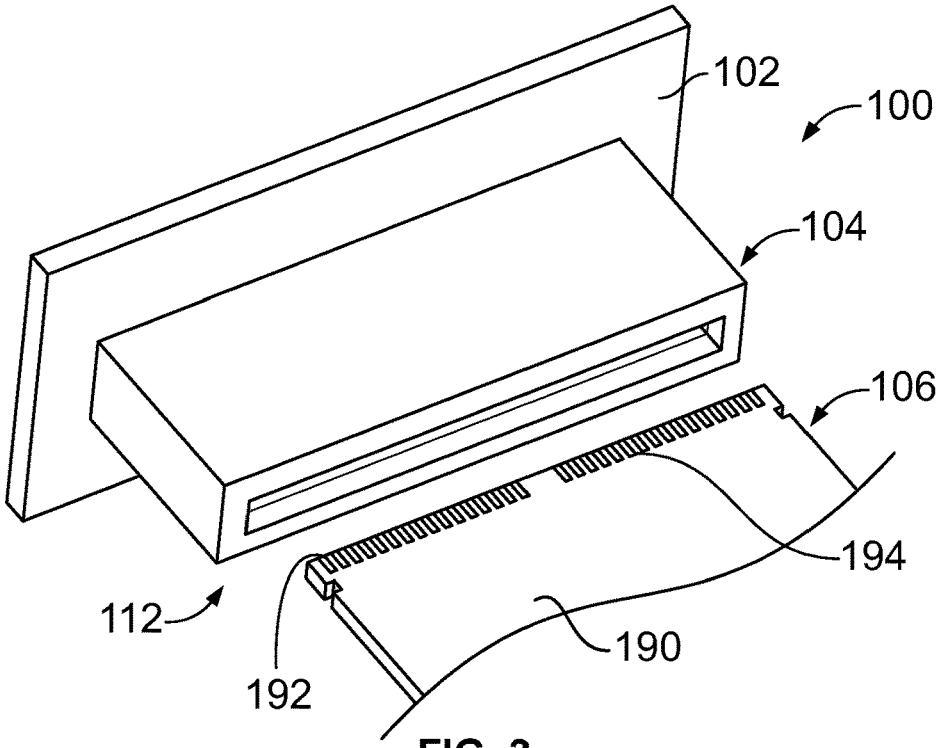
FIG. 3 is a front perspective view of the communication system in accordance with an exemplary embodiment.

FIG. 3 is a front perspective view of the communication system 100 in accordance with an exemplary embodiment. The receptacle connector assembly 104 is shown as a card edge connector 112 mounted to the host circuit board 102 (without a receptacle cage). The card edge connector 112 may be mounted horizontally or vertically in various embodiments. The card edge connector 112 may be mounted to the circuit board 102 to receive the pluggable module(s) 106 in a direction perpendicular to the circuit board 102 in various embodiments. In alternative embodiments, the card edge connector 112 may be a right-angle card edge connector mounted to the circuit board 102 to receive the pluggable module 106 in a direction parallel to the circuit board 102. In the illustrated embodiment, the receptacle connector assembly 104 is a pass-through connector having the mating end and the mounting end of the housing parallel to each other rather than perpendicular to each other such that the contacts pass straight through the housing rather than being right angle contacts.

In the illustrated embodiment, the pluggable module 106 includes the module circuit board 190 without the outer pluggable body (shown in FIG. 2) holding the module circuit board 190. The module circuit board 190 includes the card edge 192 between a first or upper surface and a second or lower surface at a mating end of the module circuit board 190. The module circuit board 190 includes the mating contacts 194 at the card edge 192, such as at both the upper surface and the lower surface, configured to be mated with the contacts of the card edge connector 112.

Figure 4:
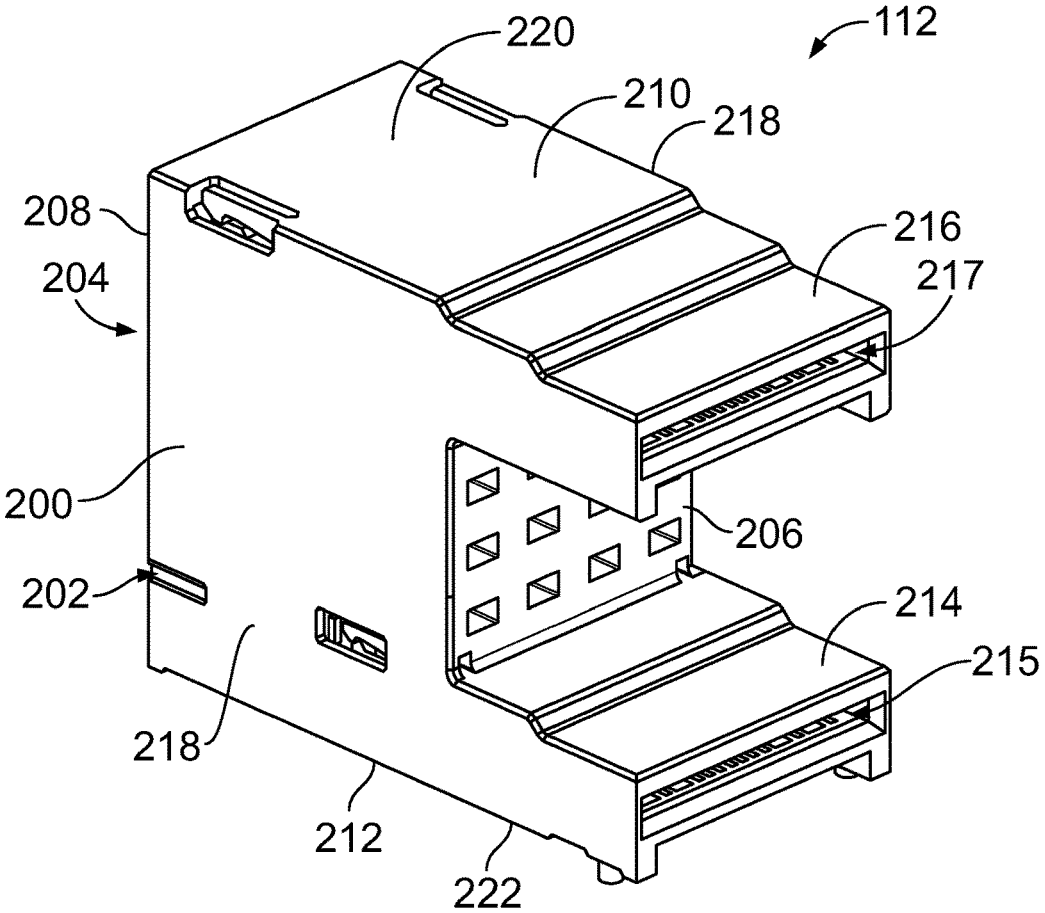
FIG. 4 is a front perspective view of the card edge connector in accordance with an exemplary embodiment.

FIG. 4 is a front perspective view of the card edge connector 112 in accordance with an exemplary embodiment. The card edge connector 112 includes a housing 200 having a contact assembly 202 received in a cavity 204 of the housing 200. The housing 200 extends between a front 206 and a rear 208. The cavity 204 is open at the rear 208 to receive the contact assembly 202. The housing 200 extends between a top 210 and a bottom 212. The housing 200 extends between opposite sides 218. The housing 200 may be generally box shaped in various embodiments. In the illustrated embodiment, the bottom 212 defines a mounting end configured to be mounted to the host circuit board 102 (shown in FIG. 1) and the front 206 defines the mating end configured to be mated with the pluggable module 106 (shown in FIG. 1). Other orientations are possible in alternative embodiments.

The housing 200 includes a top wall 220 at the top 210 and a bottom wall 222 at the bottom 212. In the illustrated embodiment, the housing 200 includes an inner shroud 214 and an outer shroud 216 at the front 206 configured to be mated with the pluggable modules 106. The outer shroud 216 is located above the inner shroud 214 closer to the top 210. The inner shroud 214 is located below the outer shroud 216 and is configured to be closer to the host circuit board 102. The shrouds 214, 216 are configured to be received in the pluggable module 106. The inner shroud 214 includes an inner housing card slot 215 and the outer shroud 216 includes an outer housing card slot 217. The housing card slots 215, 217 are open at the front of the shrouds 214, 216. The housing card slots 215, 217 receive the card edges 192 (shown in FIG. 2) of the module circuit boards 190 (shown in FIG. 2).

Figure 5:
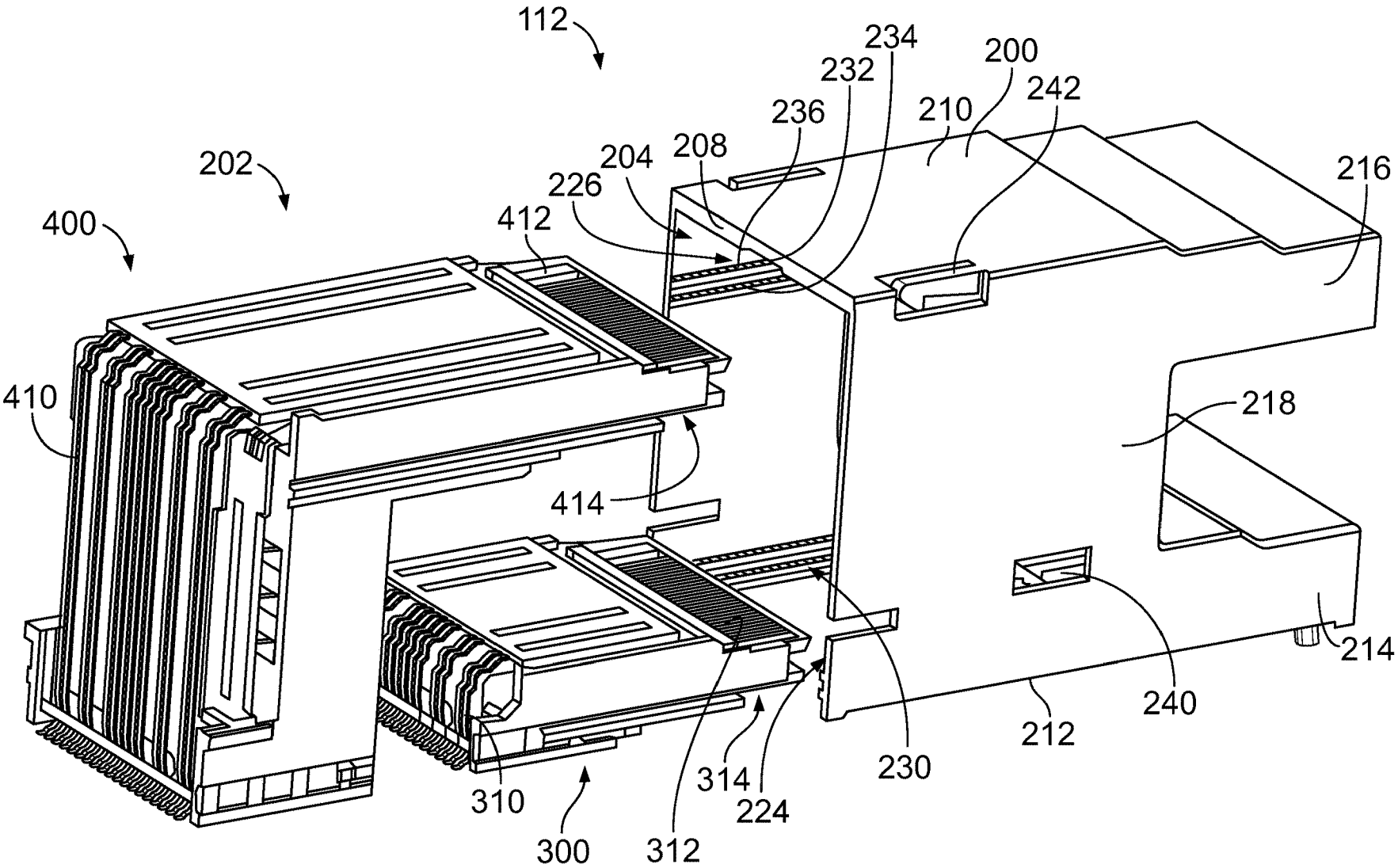
FIG. 5 is an exploded view of the card edge connector in accordance with an exemplary embodiment.

FIG. 5 is an exploded view of the card edge connector 112 in accordance with an exemplary embodiment. In an exemplary embodiment, the contact assembly 202 includes an inner contact assembly 300 and an outer contact assembly 400. The inner contact assembly 300 is positioned interior of the outer contact assembly 400. The inner contact assembly 300 is configured to be coupled to the inner (lower) pluggable module 106 and the outer contact assembly 400 is configured to be coupled to the outer (upper) pluggable module 106.

In an exemplary embodiment, the inner contact assembly 300 is a double-sided, multi-row contact assembly. For example, the inner contact assembly 300 includes inner contacts 310, which include upper contacts 312 and lower contacts 314 arranged on opposite sides of the card slot. The upper contacts 312 are arranged in multiple rows (front row and rear row) and the lower contacts 314 are arranged in multiple rows (front row and rear row). As such, the inner contact assembly 300 has high density and significant data throughput.

In an exemplary embodiment, the outer contact assembly 400 is a double-sided, multi-row contact assembly. For example, the outer contact assembly 400 includes outer contacts 410, which include upper contacts 412 and lower contacts 414 arranged on opposite sides of the card slot. The upper contacts 412 are arranged in multiple rows (front row and rear row) and the lower contacts 414 are arranged in multiple rows (front row and rear row). As such, the outer contact assembly 400 has high density and significant data throughput.

The contact assemblies 300, 400 are loaded into the cavity 204 of the housing 200. For example, the contact assemblies 300, 400 are loaded through the rear 208 into the cavity 204. In an exemplary embodiment, the housing 200 includes an inner contact channel 224 at the bottom 212 and an outer contact channel 226 at the top 210. The inner contact channel 224 is located below the outer contact channel 226. The inner contact channel 224 is aligned with the inner shroud 214. The outer contact channel 226 is aligned with the outer shroud 216. The inner contact channel 224 receives the inner contact assembly 300. The outer contact channel 226 receives the outer contact assembly 400.

In an exemplary embodiment, the housing 200 includes inner housing locating features 230 proximate to the bottom 212 and outer housing locating features 232 proximate to the top 210. The inner housing locating features 230 are used to position the inner contact assembly 300 in the housing 200. The outer housing locating features 232 are used to position the outer contact assembly 400 in the housing 200. The housing locating features 230, 232 are provided along the sides 218 proximate to the bottom 212 and the top 210, respectively. In an exemplary embodiment, the housing locating features 230, 232 includes rails 234 and slots 236 configured to interface with the contact assemblies 300, 400. Other types of locating features may be used in alternative embodiments.

In an exemplary embodiment, the housing 200 includes inner housing latching features 240 proximate to the bottom 212 and outer housing latching features 242 proximate to the top 210. The inner housing latching features 240 are used to latchably secure the inner contact assembly 300 in the housing 200. The outer housing latching features 242 are used to latchably secure the outer contact assembly 400 in the housing 200. The housing latching features 240, 242 are provided along both sides 218. The housing latching features 240, 242 are deflectable and releasable. Other types of securing features may be used in alternative embodiments.

Figure 6:
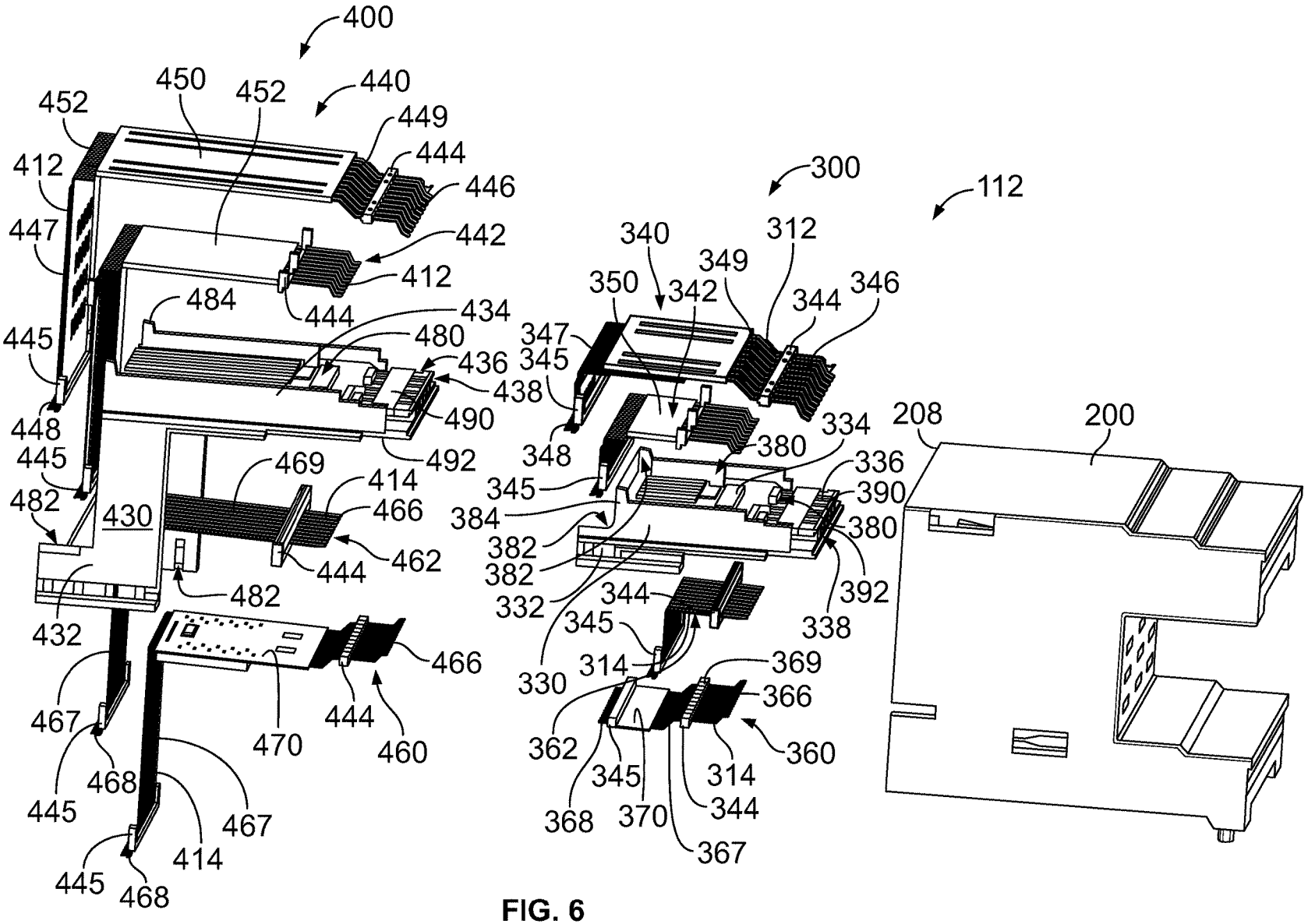
FIG. 6 is an exploded view of the card edge connector in accordance with an exemplary embodiment.

FIG. 6 is an exploded view of the card edge connector 112 in accordance with an exemplary embodiment. The inner and outer contact assemblies 300, 400 are shown exploded. The inner and outer contact assemblies 300, 400 include similar components, which may be sized and shaped differently for loading into the housing 200.

The outer contact assembly 400 includes an outer contact positioner 430 supporting the upper contacts 412 and the lower contacts 414. The outer contact positioner 430 is used to position the upper and lower contacts 412, 414 relative to each other. The outer contact positioner 430 is used to hold the contact arrays for loading the outer contact assembly 400 into the housing 200. In an exemplary embodiment, the contacts 412, 414 are movable relative to the outer contact positioner 430 for proper alignment and positioning for mating with the pluggable module 106 and mounting to the host circuit board 102. In various embodiments, the housing 200 is used to properly position the contacts 412, 414.

In an exemplary embodiment, the upper contacts 412 are arranged in a first upper contact array 440 and a second upper contact array 442. The upper contact arrays 440, 442 may be leadframes having stamped and formed contacts forming the upper contacts 412. The mating ends of the upper contacts 412 of the first upper contact array 440 are arranged in a first upper row and the mating ends of the upper contacts 412 of the second upper contact array 442 are arranged in a second upper row parallel to and spaced apart from the first upper row. The mounting ends of the upper contacts 412 of the first upper contact array 440 are arranged in a first row and the mounting ends of the upper contacts 412 of the second upper contact array 442 are arranged in a second row parallel to and spaced apart from the first row. In an exemplary embodiment, the lower contacts 414 are arranged in a first lower contact array 460 and a second lower contact array 462. The lower contact arrays 460, 462 may be leadframes having stamped and formed contacts forming the lower contacts 414. The mating ends of the lower contacts 414 of the first lower contact array 460 are arranged in a first lower row and the mating ends of the lower contacts 414 of the second lower contact array 462 are arranged in a second lower row parallel to and spaced apart from the first lower row. The mounting ends of the lower contacts 414 of the first lower contact array 460 are arranged in a first row and the mounting ends of the lower contacts 414 of the second lower contact array 462 are arranged in a second row parallel to and spaced apart from the first row.

In an exemplary embodiment, the contacts 412, 414 are held by contact holders. For example, the upper and lower contact arrays 440, 442, 460, 462 each include an outer front contact holder (444*a*, 444*b*, 444*c*, 444*d*, respectively, and generally referred to hereinafter as outer front contact holder 444) and/or an outer rear contact holder (445*a*, 445*b*, 445*c*, 445*d*, respectively, and generally referred to hereinafter as outer rear contact holder 445). The front contact holder 444 is positioned proximate to front ends of the contacts 412, 414. The rear contact holder 445 is positioned proximate to rear ends of the contacts 412, 414. The contact holders 444, 445 encase portions of the contacts 412, 414. In various embodiments, the contact holders 444, 445 are dielectric bodies, such as overmold bodies that are overmolded around portions of the contacts 412, 414, to hold the relative positions of the front and rear ends of the contacts 412, 414, such as for loading the contacts 412, 414 into the outer contact positioner 430. In an exemplary embodiment, the front and rear contact holders 444, 445 are spaced apart from each other. For example, sections of the contacts 412, 414 extend, un-encased, between the contact holders 444, 445. The contacts 412, 414 are independently and freely movable between the contact holders 444, 445. For example, portions of the contacts 412, 414 may be flexed, compressed, shifted, or otherwise moved relative to each other to position the mating ends and the mounting ends within the contact positioner 430.

The contact holders 444, 445 are coupled to the outer contact positioner 430 to load the upper and lower contacts 412, 414 in the outer contact positioner 430 to form the outer contact assembly 400. The assembled outer contact assembly 400 is configured to be loaded into the housing 200, such as through the rear 208 of the housing 200.

The outer contact positioner 430 includes a base 432, arms 434 extending from the base 432 and a nose 436 between the arms 434. The outer contact positioner 430 has an outer positioner card slot 438 in the nose 436. The outer positioner card slot 438 receives the card edge 192 of the module circuit board 190 (shown in FIG. 2). The base 432 holds the upper and lower contacts 412, 414. For example, the base 432 may hold the rear contact holders 445. The nose 436 holds the upper and lower contacts 412, 414. For example, the nose 436 may hold the front contact holders 444. The upper and lower contacts 412, 414 are loaded into the base 432 and into the nose 436 to position the upper and lower contacts 412, 414 for mating with the module circuit board 190 and for mounting to the host circuit board 102 (shown in FIG. 1).

Figure 7:
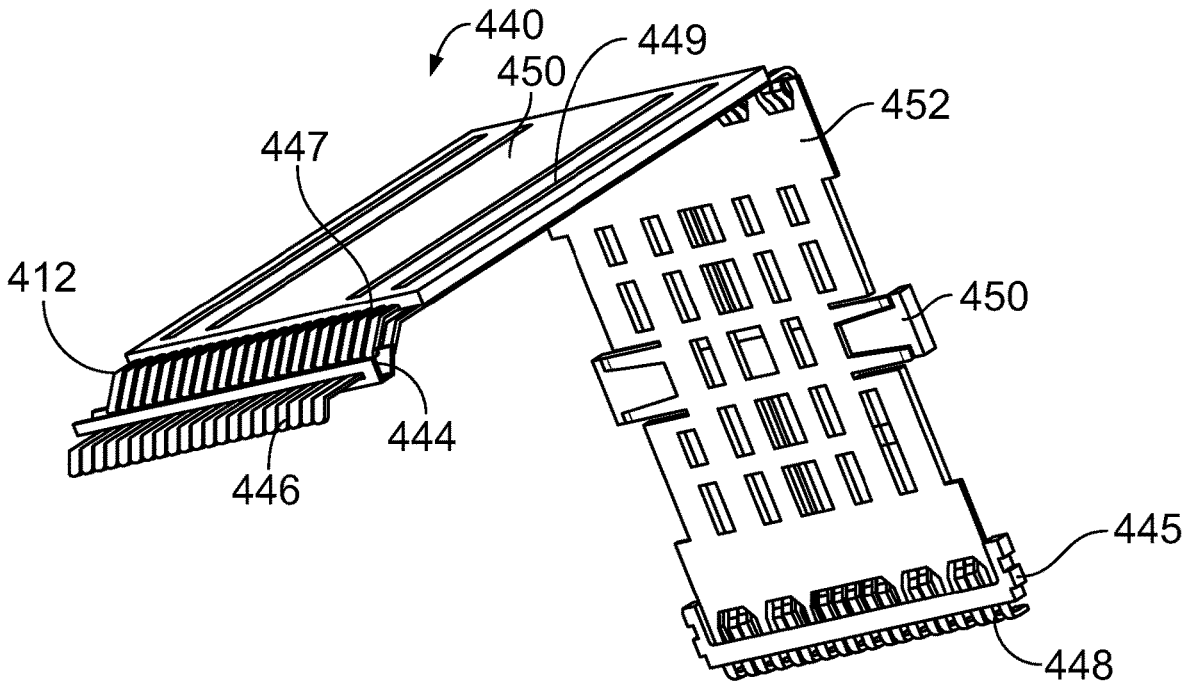
FIG. 7 is a front perspective view of a portion of the outer contact assembly in accordance with an exemplary embodiment.
Figure 8:
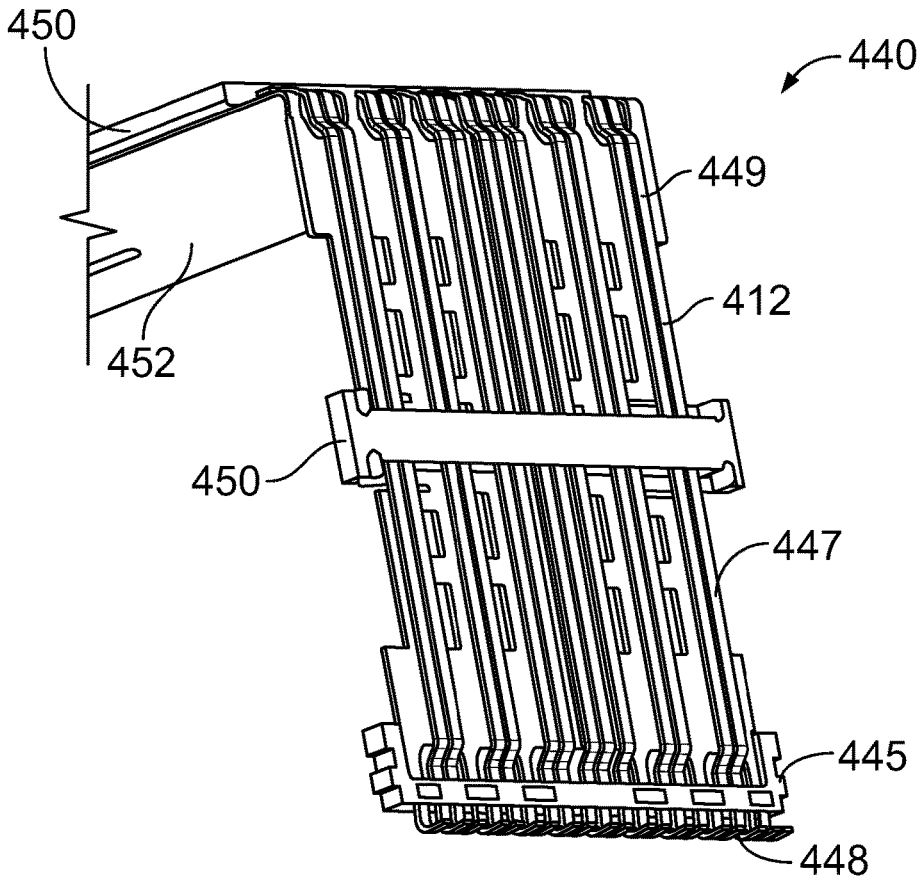
FIG. 8 is a rear perspective view of a portion of the outer contact assembly in accordance with an exemplary embodiment.

With additional reference to FIGS. 7 and 8, FIG. 7 is a front perspective view of a portion of the outer contact assembly 400 and FIG. 8 is a rear perspective view of a portion of the outer contact assembly 400. Each upper contact 412 includes a transition portion 447 extending between a mating beam 446 at a mating end and a contact tail 448 at a terminating end. The front contact holder 444 supports the mating beams 446 of the upper contacts 412. For example, the front contact holder 444 is provided at the mating beams 446 and/or the transition portions 447. Optionally, portions of the mating beams 446 and/or front portions of the transition portions 447 may be encased in the front contact holder 444. The mating beams 446 extend forward of the front contact holder 444 for mating with the module circuit board 190. The mating beams 446 are configured to be coupled to the nose 436. The mating beams 446 may extend into the shroud 214 for mating with the module circuit board 190.

The upper rear contact holders 445*a*, 445*b* support the contact tails 448 of the upper contacts 412. For example, the upper rear contact holder 445*a*, 445*b* is provided at the contact tails 448 and/or the transition portions 447. Optionally, portions of the contact tails 448 and/or rear portions of the transition portions 447 may be encased in the rear contact holder 445*a*, 445*b*. The contact tails 448 extend from the rear contact holder 445*a*, 445*b* for termination to the host circuit board 102. For example, the contact tails 448 may be solder tails configured to be soldered to the host circuit board 102. The contact tails 448 may be coupled to the base 432.

In an exemplary embodiment, each upper contact 412 includes an intermediate portion 449 extending between the upper front contact holder 444*a*, 444*b* and the upper rear contact holder 445*a*, 445*b*. The intermediate portions 449 may be bent along various sections to transition between the front contact holders 444*a*, 444*b* and the rear contact holders 445*a*, 445*b*, respectively. In an exemplary embodiment, the upper contact array 440 includes intermediate contact holders 450. The intermediate contact holders 450 hold the intermediate portions 449 of the upper contacts 412. The intermediate contact holders 450 may be overmolded bodies overmolded over the upper contacts 412. The length of the intermediate portions 449 encased by the intermediate contact holders 450 may be selected to control impedance of the signal conductors. The intermediate contact holders 450 are located to support the intermediate portions 449 to hold relative positions of the intermediate portions 449, such as being centered along lengths of the intermediate portions 449.

Various upper contacts 412 may be signal contacts and other upper contacts 412 may be ground contacts, such as interspersed between signal contacts or pairs of signal contacts. In an exemplary embodiment, the upper contacts 412 are flexible and configured to be elastically deformed and flexed, such as during assembly and during mating with the module circuit board 190. For example, the intermediate portions 449 may be flexed between the front contact holders 444*a*, 444*b* and the rear contact holders 445*a*, 445*b*, respectively, such as for relative positioning of the mating beams 446 and the contact tails 448. The mating beams 446 may be cantilevered spring beams extending forward from the front contact holder 444*a*, 444*b* configured to be flexed when mated with the module circuit board 190. The contact tails 448 may be flexed when mounted to the host circuit board 102.

In an exemplary embodiment, the outer contact assembly 400 includes upper ground plates 452 providing electrical shielding for the signal conductors. The signal conductors may be close coupled to the upper ground plate 452 to reduce cross talk between the signal conductors. The upper ground plates 452 may span across the entire outer contact assembly 400. The ground contacts are electrically connected to the upper ground plates 452. In an exemplary embodiment, the ground contacts are integral with the ground plates 452, such as being part of a unitary, monolithic structure. The ground contacts may be stamped from the upper ground plates 452 and extend from the upper ground plates 452. In various embodiments, the ground beams and the ground tails may extend from the upper ground plates 452. The upper ground plates 452 may be coupled to the intermediate contact holders 450, such as using clips, tabs or other securing features.

Each lower contact 414 includes a transition portion 467 extending between a mating beam 466 at a mating end and a contact tail 468 at a terminating end. The lower front contact holder 444*c*, 444*d* supports the mating beams 466 of the lower contacts 414. For example, the lower front contact holder 444*c*, 444*d* is provided at the mating beams 466 and/or the transition portions 467. Optionally, portions of the mating beams 466 and/or front portions of the transition portions 467 may be encased in the lower front contact holder 444*c*, 444*d*. The mating beams 466 extend forward of the lower front contact holder 444*c*, 444*d* for mating with the module circuit board 190. The mating beams 466 are configured to be coupled to the nose 436. The mating beams 466 may extend into the shroud 214 for mating with the module circuit board 190.

The lower rear contact holder 445*c*, 445*d* supports the contact tails 468 of the lower contacts 414. For example, the lower rear contact holder 445*c*, 445*d* is provided at the contact tails 468 and/or the transition portions 467. Optionally, portions of the contact tails 468 and/or rear portions of the transition portions 467 may be encased in the lower rear contact holder 445*c*, 445*d*. The contact tails 468 extend from the lower rear contact holder 445*c*, 445*d* for termination to the host circuit board 102. For example, the contact tails 468 may be solder tails configured to be soldered to the host circuit board 102. The contact tails 468 may be coupled to the base 432.

In an exemplary embodiment, each lower contact 414 includes an intermediate portion 469 extending between the lower front contact holder 444*c*, 444*d* and the lower rear contact holder 445*c*, 445*d*. The intermediate portions 469 may be bent along various sections to transition between the lower front contact holder 444*c*, 444*d* and the lower rear contact holders 445*c*, 445*d*.

Various lower contacts 414 may be signal contacts and other lower contacts 414 may be ground contacts, such as interspersed between signal contacts or pairs of signal contacts. In an exemplary embodiment, the lower contacts 414 are flexible and configured to be elastically deformed and flexed, such as during assembly and during mating with the module circuit board 190. For example, the intermediate portions 469 may be flexed between the lower front contact holders 444*c*, 444*d* and the lower rear contact holder 445*c*, 445*d*, such as for relative positioning of the mating beams 466 and the contact tails 468. The mating beams 466 may be cantilevered spring beams extending forward from the lower front contact holder 444*c*, 444*d* configured to be flexed when mated with the module circuit board 190. The contact tails 468 may be flexed when mounted to the host circuit board 102.

In an exemplary embodiment, the lower contact assembly 400 includes lower ground plates 470 providing electrical shielding for the signal conductors. The signal conductors may be close coupled to the lower ground plate 470 to reduce cross talk between the signal conductors. The lower ground plates 470 may span across the entire lower contact assembly 400. The ground contacts are electrically connected to the lower ground plates 470. The ground contacts may be stamped from the lower ground plates 470 and extend from the lower ground plates 470. For example, the ground beams and the ground tails may extend from the lower ground plates 470.

The upper and lower contact holders 444, 445 are coupled to the contact positioner 430 to load the upper and lower contacts 412, 414 into the contact positioner 430. In the illustrated embodiment, the transition portions 447, 467 are bent through a 90 degree transition from the mating beams 446, 466 to the contact tails 448, 468. Other orientations are possible in alternative embodiments.

In an exemplary embodiment, the arms 434 of the outer contact positioner 430 extend forward from the base 432 to support the nose 436. The arms 434 and/or the base 432 and/or the nose 436 include front locating channels 480 and rear locating channels 482 that receive the front and rear contact holders 444, 445, respectively. The locating channels 480, 482 may be open at the top to receive the contact holders 444, 445 of the upper contact arrays 440, 442. The locating channels 480, 482 may be open at the bottom to receive the contact holders 444, 445 of the lower contact arrays 460, 462.

In an exemplary embodiment, the outer contact positioner 430 is a right-angle contact positioner having a mating end at a front of the contact positioner 430 and a mounting end at a bottom of the contact positioner 430. The base 432 is provided at the bottom. The nose 436 is provided at the mating end. Other orientations are possible in alternative embodiments, such as with the nose 436 at a top of the contact positioner 430 and/or the base 432 at a rear of the contact positioner 430.

In an exemplary embodiment, the contact positioner 430 includes securing features 484 for securing the contact positioner 430 in the housing 200. The securing features 484 may be latches, catch tabs, or other types of securing features. The securing features 484 may be provided on the arms 434 and/or the base 432 and/or the nose 436.

The nose 436 includes an upper wall 490 and a lower wall 492. The positioner card slot 438 is located between the upper wall 490 and the lower wall 492. The upper wall 490 receives and supports the mating beams 446 of the upper contacts 412. The lower wall 492 receives and supports the mating beams 466 of the lower contacts 414.

The inner contact assembly 300 includes an inner contact positioner 330 supporting the upper contacts 312 and the lower contacts 314. The inner contact positioner 330 is used to position the upper and lower contacts 312, 314 relative to each other. The inner contact positioner 330 is used to hold the contact arrays for loading the inner contact assembly 300 into the housing 200. In an exemplary embodiment, the contacts 312, 314 are movable relative to the inner contact positioner 330 for proper alignment and positioning for mating with the pluggable module 106 and mounting to the host circuit board 102. In various embodiments, the housing 200 is used to properly position the contacts 312, 314.

In an exemplary embodiment, the upper contacts 312 are arranged in a first upper contact array 340 and a second upper contact array 342. The upper contact arrays 340, 342 may be leadframes having stamped and formed contacts forming the upper contacts 312. The mating ends of the upper contacts 312 of the first upper contact array 340 are arranged in a first upper row and the mating ends of the upper contacts 312 of the second upper contact array 342 are arranged in a second upper row parallel to and spaced apart from the first upper row. The mounting ends of the upper contacts 312 of the first upper contact array 340 are arranged in a first row and the mounting ends of the upper contacts 312 of the second upper contact array 342 are arranged in a second row parallel to and spaced apart from the first row. In an exemplary embodiment, the lower contacts 314 are arranged in a first lower contact array 360 and a second lower contact array 362. The lower contact arrays 360, 362 may be leadframes having stamped and formed contacts forming the lower contacts 314. The mating ends of the lower contacts 314 of the first lower contact array 360 are arranged in a first lower row and the mating ends of the lower contacts 314 of the second lower contact array 362 are arranged in a second lower row parallel to and spaced apart from the first lower row. The mounting ends of the lower contacts 314 of the first lower contact array 360 are arranged in a first row and the mounting ends of the lower contacts 314 of the second lower contact array 362 are arranged in a second row parallel to and spaced apart from the first row.

In an exemplary embodiment, the contacts 312, 314 are held by contact holders. For example, the upper and lower contact arrays 340, 342, 360, 362 each include an inner front contact holder (344*a*, 344*b*, 344*c*, 344*d*, respectively, and generally referred to hereinafter as outer front contact holder 344) and/or an inner rear contact holder (345*a*, 345*b*, 345*c*, 345*d*, respectively, and generally referred to hereinafter as outer rear contact holder 345). The front contact holder 344 is positioned proximate to front ends of the contacts 312, 314. The rear contact holder 345 is positioned proximate to rear ends of the contacts 312, 314. The contact holders 344, 345 encase portions of the contacts 312, 314. In various embodiments, the contact holders 344, 345 are dielectric bodies, such as overmold bodies that are overmolded around portions of the contacts 312, 314, to hold the relative positions of the front and rear ends of the contacts 312, 314, such as for loading the contacts 312, 314 into the inner contact positioner 330. In an exemplary embodiment, the front and rear contact holders 344, 345 are spaced apart from each other. For example, sections of the contacts 312, 314 extend, un-encased, between the contact holders 344, 345. The contacts 312, 314 are independently and freely movable between the contact holders 344, 345. For example, portions of the contacts 312, 314 may be flexed, compressed, shifted, or otherwise moved relative to each other to position the mating ends and the mounting ends within the contact positioner 330.

The contact holders 344, 345 are coupled to the inner contact positioner 330 to load the upper and lower contacts 312, 314 in the inner contact positioner 330 to form the inner contact assembly 300. The assembled inner contact assembly 300 is configured to be loaded into the housing 200, such as through the rear 208 of the housing 200.

The inner contact positioner 330 includes a base 332, arms 334 extending from the base 332 and a nose 336 between the arms 334. The inner contact positioner 330 has an inner positioner card slot 338 in the nose 336. The inner positioner card slot 338 receives the card edge 192 of the module circuit board 190 (shown in FIG. 2). The base 332 holds the upper and lower contacts 312, 314. For example, the base 332 may hold the rear contact holders 345. The nose 336 holds the upper and lower contacts 312, 314. For example, the nose 336 may hold the front contact holders 344. The upper and lower contacts 312, 314 are loaded into the base 332 and into the nose 336 to position the upper and lower contacts 312, 314 for mating with the module circuit board 190 and for mounting to the host circuit board 102 (shown in FIG. 1).

Each upper contact 312 includes a transition portion 347 extending between a mating beam 346 at a mating end and a contact tail 348 at a terminating end. The front contact holder 344 supports the mating beams 346 of the upper contacts 312. For example, the front contact holder 344 is provided at the mating beams 346 and/or the transition portions 347. Optionally, portions of the mating beams 346 and/or front portions of the transition portions 347 may be encased in the front contact holder 344. The mating beams 346 extend forward of the front contact holder 344 for mating with the module circuit board 190. The mating beams 346 are configured to be coupled to the nose 336. The mating beams 346 may extend into the shroud 214 for mating with the module circuit board 190.

The upper rear contact holder 345*a*, 345*b* supports the contact tails 348 of the upper contacts 312. For example, the upper rear contact holder 345*a*, 345*b* is provided at the contact tails 348 and/or the transition portions 347. Optionally, portions of the contact tails 348 and/or rear portions of the transition portions 347 may be encased in the rear contact holder 345*a*, 345*b*. The contact tails 348 extend from the rear contact holder 345*a*, 345*b* for termination to the host circuit board 102. For example, the contact tails 348 may be solder tails configured to be soldered to the host circuit board 102. The contact tails 348 may be coupled to the base 332.

In an exemplary embodiment, each upper contact 312 includes an intermediate portion 349 extending between the upper front contact holder 344*a*, 344*b* and the upper rear contact holder 345*a*, 345*b*. The intermediate portions 349 may be bent along various sections to transition between the front contact holders 344*a*, 344*b* and the rear contact holders 345*a*, 345*b*.

Various upper contacts 312 may be signal contacts and other upper contacts 312 may be ground contacts, such as interspersed between signal contacts or pairs of signal contacts. In an exemplary embodiment, the upper contacts 312 are flexible and configured to be elastically deformed and flexed, such as during assembly and during mating with the module circuit board 190. For example, the intermediate portions 349 may be flexed between the upper front contact holder 344*a*, 344*b* and the upper rear contact holder 345*a*, 345*b*, such as for relative positioning of the mating beams 346 and the contact tails 348. The mating beams 346 may be cantilevered spring beams extending forward from the front contact holder 344*a*, 344*b* configured to be flexed when mated with the module circuit board 190. The contact tails 348 may be flexed when mounted to the host circuit board 102.

In an exemplary embodiment, the inner contact assembly 300 includes upper ground plates 350 providing electrical shielding for the signal conductors. The signal conductors may be close coupled to the upper ground plate 350 to reduce cross talk between the signal conductors. The upper ground plates 350 may span across the entire inner contact assembly 300. The ground contacts are electrically connected to the upper ground plates 350. The ground contacts may be stamped from the upper ground plates 350 and extend from the upper ground plates 350. For example, the ground beams and the ground tails may extend from the upper ground plates 350.

Each lower contact 314 includes a transition portion 367 extending between a mating beam 366 at a mating end and a contact tail 368 at a terminating end. The lower front contact holder 344*c*, 344*d* supports the mating beams 366 of the lower contacts 314. For example, the lower front contact holder 344*c*, 344*d* is provided at the mating beams 366 and/or the transition portions 367. Optionally, portions of the mating beams 366 and/or front portions of the transition portions 367 may be encased in the lower front contact holder 344*c*, 344*d*. The mating beams 366 extend forward of the lower front contact holder 344*c*, 344*d* for mating with the module circuit board 190. The mating beams 366 are configured to be coupled to the nose 336. The mating beams 366 may extend into the shroud 214 for mating with the module circuit board 190.

The lower rear contact holder 345*c*, 345*d* supports the contact tails 368 of the lower contacts 314. For example, the lower rear contact holder 345*c*, 345*d* is provided at the contact tails 368 and/or the transition portions 367. Optionally, portions of the contact tails 368 and/or rear portions of the transition portions 367 may be encased in the lower rear contact holder 345*c*, 345*d*. The contact tails 368 extend from the lower rear contact holder 345*c*, 345*d* for termination to the host circuit board 102. For example, the contact tails 368 may be solder tails configured to be soldered to the host circuit board 102. The contact tails 368 may be coupled to the base 332.

In an exemplary embodiment, each lower contact 314 includes an intermediate portion 369 extending between the lower front contact holder 344*c*, 344*d* and the lower rear contact holder 345*c*, 345*d*. The intermediate portions 369 may be bent along various sections to transition between the front contact holder 344*c*, 344*d* and the lower rear contact holder 345*c*, 345*d*.

Various lower contacts 314 may be signal contacts and other lower contacts 314 may be ground contacts, such as interspersed between signal contacts or pairs of signal contacts. In an exemplary embodiment, the lower contacts 314 are flexible and configured to be elastically deformed and flexed, such as during assembly and during mating with the module circuit board 190. For example, the intermediate portions 369 may be flexed between the front contact holder 344*c*, 344*d* and the lower rear contact holder 345*c*, 345*d*, such as for relative positioning of the mating beams 366 and the contact tails 368. The mating beams 366 may be cantilevered spring beams extending forward from the lower front contact holder 344*c*, 344*d* configured to be flexed when mated with the module circuit board 190. The contact tails 368 may be flexed when mounted to the host circuit board 102.

In an exemplary embodiment, the lower contact assembly 300 includes lower ground plates 370 providing electrical shielding for the signal conductors. The signal conductors may be close coupled to the lower ground plate 370 to reduce cross talk between the signal conductors. The lower ground plates 370 may span across the entire lower contact assembly 300. The ground contacts are electrically connected to the lower ground plates 370. The ground contacts may be stamped from the lower ground plates 370 and extend from the lower ground plates 370. For example, the ground beams and the ground tails may extend from the lower ground plates 370.

The front and rear contact holders 344, 345 are coupled to the contact positioner 330 to load the upper and lower contacts 312, 314 into the contact positioner 330. In the illustrated embodiment, the transition portions 347, 367 are bent through a 90 degree transition from the mating beams 346, 366 to the contact tails 348, 368. Other orientations are possible in alternative embodiments.

In an exemplary embodiment, the arms 334 extend forward from the base 332 to support the nose 336. The arms 334 and/or the base 332 and/or the nose 336 include front locating channels 380 and rear locating channels 382 that receive the front and rear contact holders 344, 345, respectively. The locating channels 380, 382 may be open at the top to receive the contact holders 344, 345 of the upper contact arrays 340, 342. The locating channels 380, 382 may be open at the bottom to receive the contact holders 344, 345 of the lower contact arrays 360, 362.

In an exemplary embodiment, the inner contact positioner 330 is a right-angle contact positioner having a mating end at a front of the contact positioner 330 and a mounting end at a bottom of the contact positioner 330. The base 332 is provided at the bottom. The nose 336 is provided at the mating end. Other orientations are possible in alternative embodiments, such as with the nose 336 at a top of the contact positioner 330 and/or the base 332 at a rear of the contact positioner 330.

In an exemplary embodiment, the contact positioner 330 includes securing features 384 for securing the contact positioner 330 in the housing 200. The securing features 384 may be latches, catch tabs, or other types of securing features. The securing features 384 may be provided on the arms 334 and/or the base 332 and/or the nose 336.

The nose 336 includes an upper wall 390 and a lower wall 392. The positioner card slot 338 is located between the upper wall 390 and the lower wall 392. The upper wall 390 receives and supports the mating beams 346 of the upper contacts 312. The lower wall 392 receives and supports the mating beams 366 of the lower contacts 314.

Figure 9:
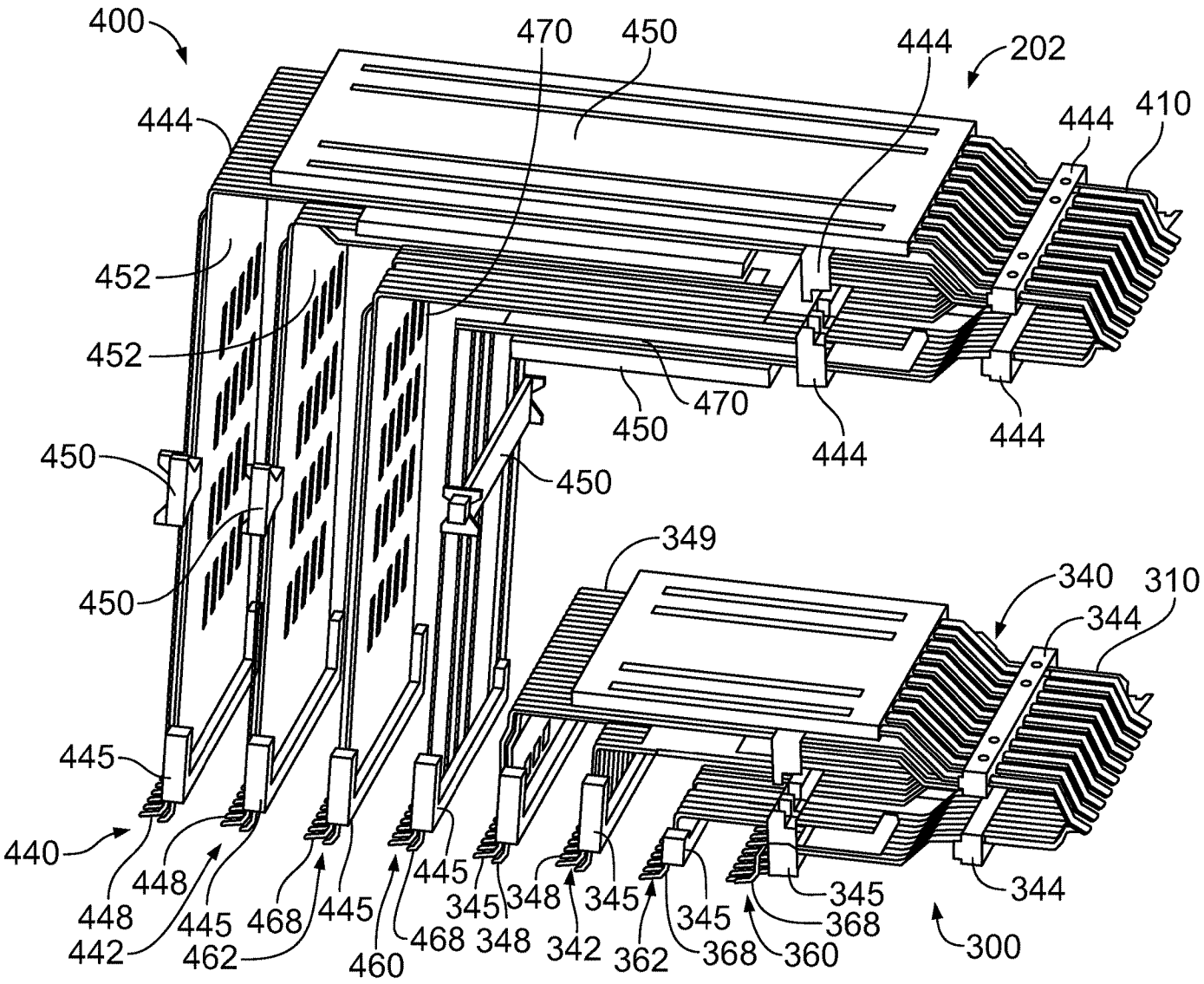
FIG. 9 is a perspective view of a portion of the contact assembly in accordance with an exemplary embodiment.

FIG. 9 is a perspective view of a portion of the contact assembly 202 in accordance with an exemplary embodiment showing the inner and outer contact assemblies 300, 400 with the inner and outer contact positioners 330, 430 (shown in FIG. 6) removed to illustrate the contact arrays 340, 342, 360, 362, 440, 442, 460, 462. The contact assemblies 300, 400 are double-sided, multi-row contact assemblies. The inner contact assembly 300 includes the inner contacts 310 forming front and rear upper rows and front and rear lower rows on opposite sides of the card slot. The outer contact assembly 400 includes the outer contacts 410 forming front and rear upper rows and front and rear lower rows. In an exemplary embodiment, the contact tails 348, 368, 448, 468 are coplanar in spaced apart rows along the bottom of the contact assembly 202 for surface mounting to the host circuit board 102 (shown in FIG. 1).

The front and rear contact holders 344, 345 are used to fix the ends of the inner contacts 310 relative to each other. Intermediate contact holders 352 are used to hold the intermediate portions 349 of the inner contacts 310. As such, the inner contacts 310 are supported at different sections along the lengths of the inner contacts 310 for mechanical stability and to properly position the inner contacts 310 for loading into the inner contact positioner 330. During assembly, the front and rear contact holders 344, 345 are configured to be loaded into the front and rear locating channels 380, 382 (shown in FIG. 6) to position the inner contacts 310 relative to the inner contact positioner 330.

The front and rear contact holders 444, 445 are used to fix the ends of the outer contacts 410 relative to each other. The intermediate contact holders 450 are used to hold the intermediate portions 449 of the outer contacts 410. As such, the outer contacts 410 are supported at different sections along the lengths of the outer contacts 410 for mechanical stability and to properly position the outer contacts 410 for loading into the outer contact positioner 430. The ground plates 452, 470 are configured to be coupled to the intermediate contact holders 450 to position the ground plates 452, 470 relative to the outer contacts 410. During assembly, the front and rear contact holders 444, 445 are configured to be loaded into the front and rear locating channels 480, 482 (shown in FIG. 6) to position the outer contacts 410 relative to the outer contact positioner 430.

Figure 10:
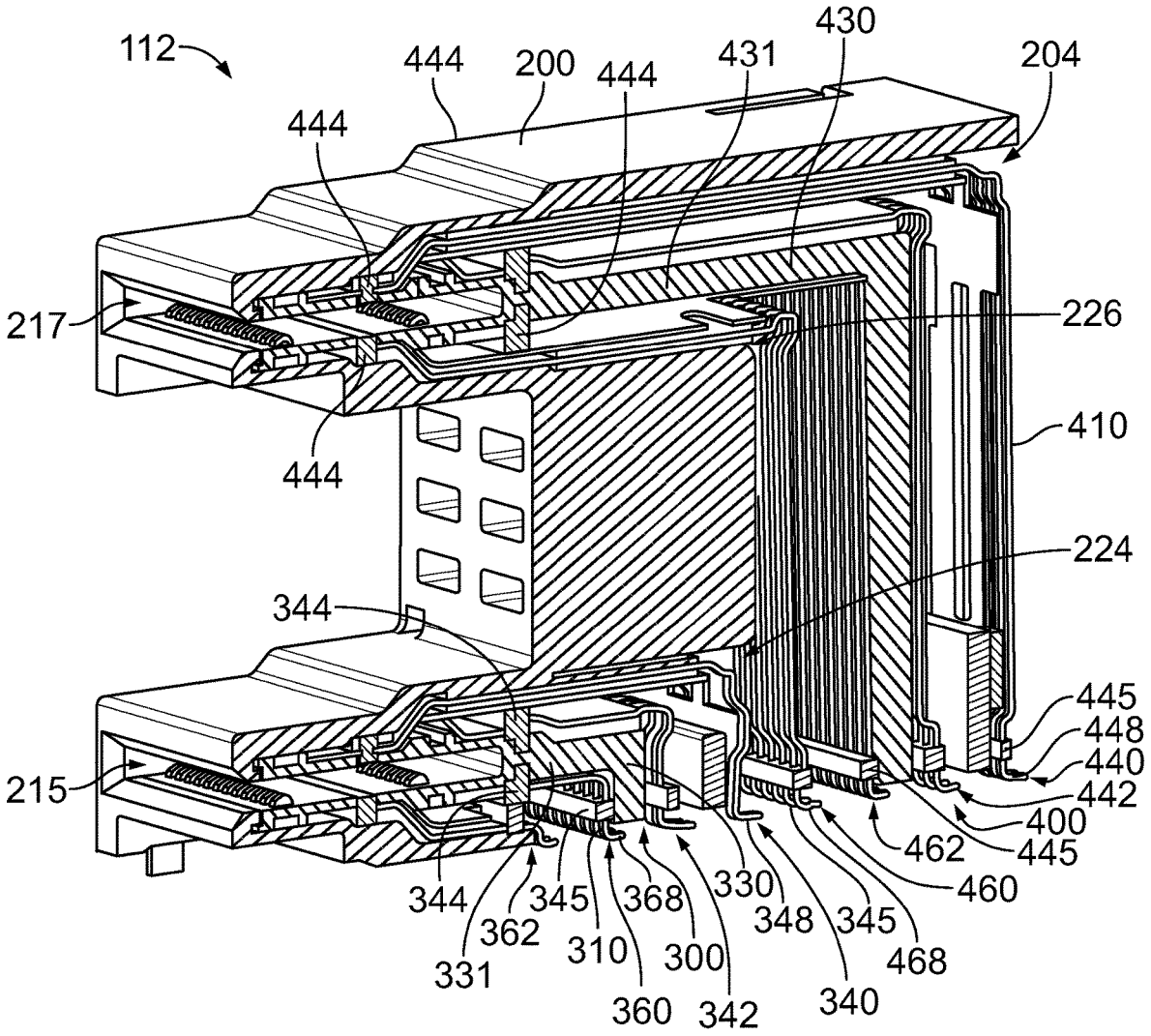
FIG. 10 is a cross sectional view of the card edge connector in accordance with an exemplary embodiment.

FIG. 10 is a cross sectional view of the card edge connector 112 in accordance with an exemplary embodiment. The inner and outer contact assemblies 300, 400 are loaded into the cavity 204 of the housing 200. The inner contact assembly 300 is received in the inner contact channel 224 and the outer contact assembly 400 is received in the outer contact channel 226. The inner contacts 310 are arranged in the inner housing card slot 215, such as in two rows. The outer contacts 410 are arranged in the outer housing card slot 217, such as in two rows.

The inner and outer contact positioners 330, 430 are used to hold and position the inner and outer contacts 310, 410, respectively, in the housing 200 at both the mating end for connection with the pluggable modules 106 (shown in FIG. 2) and the mounting end for connection with the host circuit board 102 (shown in FIG. 1). In an exemplary embodiment, the inner contact positioner 330 includes a center wall 331 located between the upper contact arrays 340, 342 and the lower contact arrays 360, 362. The center wall 331 supports and positioners the front contact holders 344 to locate the inner contacts 310 in the housing 200. In an exemplary embodiment, the outer contact positioner 430 includes a center wall 431 located between the upper contact arrays 440, 442 and the lower contact arrays 200, 462. The center wall 431 supports and positioners the front contact holders 444 to locate the outer contacts 410 in the housing 200. The housing 200 and the contact positioners 330, 430 cooperate to properly position the inner and outer contacts 310, 410 in a reliable manner. The contact tails 348, 368, 448, 468 are positioned for termination to the host circuit board 102. For example, the contact tails 348, 368, 448, 468 are held coplanar for surface mounting to the host circuit board 102, such as soldering to the host circuit board 102. The alignment features provided by the contact holders 344, 345, 444, 445 properly orient the inner and outer contacts 310, 410 in select areas without the need for entirely encasing the contact leadframes, which saves material and cost and allows for higher electrical performance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A stacked card edge connector for mating with stacked pluggable modules, the stacked card edge connector comprising:

a housing including a top and a bottom, the housing having a front and a rear, the housing having a first side and a second side, the bottom configured to be mounted to a host circuit board, the housing including a cavity at the rear, the housing including an inner contact channel and an outer contact channel, the inner contact channel closer to the bottom and the host circuit board, the housing including an inner card slot open to the inner contact channel at the front of the housing, the housing including an outer card slot open to the outer contact channel at the front of the housing, the inner and outer card slots configured to receive card edges of module circuit boards of the stacked pluggable modules;

an inner contact assembly received in the cavity, the inner contact assembly having an inner contact positioner holding inner contacts in an upper contact array and a lower contact array, the inner contact positioner having an upper wall and a lower wall with an inner positioner card slot defined therebetween, the upper wall supporting each of the inner contacts of the upper contact array of the inner contact assembly relative to each other, the lower wall supporting each of the inner contacts of the lower contact array of the inner contact assembly relative to each other, the inner contact positioner is positioned in the inner contact channel aligned with the inner card slot to receive the card edge of the module circuit board, the inner contact positioner including an inner locating feature engaging the housing to position the inner contacts relative to the housing for electrical connection with the host circuit board and the corresponding pluggable module; and an outer contact assembly received in the cavity, the outer contact assembly having an outer contact positioner holding outer contacts in an upper contact array and a lower contact array, the outer contact positioner having an upper wall and a lower wall with an outer positioner card slot defined therebetween, the upper wall supporting each of the outer contacts of the upper contact array of the outer contact assembly relative to each other, the lower wall supporting each of the outer contacts of the lower contact array of the outer contact array assembly relative to each other, the outer contact positioner is positioned in the outer contact channel aligned with the outer card slot to receive the card edge of the module circuit board, the outer contact positioner including an outer locating feature engaging the housing to position the outer contacts relative to the housing for electrical connection with the host circuit board and the corresponding pluggable module.

2. The card edge connector of claim 1, wherein the inner contact assembly is a double-sided, multi-row contact assembly and the outer contact assembly is a double-sided, multi-row contact assembly.

3. The card edge connector of claim 1, wherein the outer locating feature includes grooves, the housing including rails extending into the cavity, the grooves receiving the rails to position the outer contact positioner in the cavity.

4. The card edge connector of claim 1, wherein the outer contact positioner includes a center wall, the upper contact array coupled to the outer contact positioner exterior of the center wall, the lower contact assembly coupled to the outer contact positioner interior of the center wall.

5. The card edge connector of claim 1, wherein the outer contact positioner includes side walls having front locating channels and rear locating channels, the upper contact array including a front contact holder and a rear contact holder holding the corresponding outer contacts, the lower contact assembly including a front contact holder and a rear contact holder holding the corresponding outer contacts, the front contact holders received in the corresponding front locating channels, the rear contact holders received in the corresponding rear locating channels.

6. The card edge connector of claim 5, wherein the front contact holder and the rear contact holder of the upper contact array are loaded into the front locating channels and the rear locating channels from above, and wherein the front contact holder and the rear contact holder of the lower contact array are loaded into the front locating channels and the rear locating channels from below.

7. The card edge connector of claim 1, wherein the outer contacts include upper contacts forming the upper contact array and lower contacts forming the lower contact array;

wherein the upper contacts include upper intermediate portions extending between upper mating beams and upper contact tails, the upper mating beams extending into the outer positioner card slot, the upper contact tails extending from the outer contact positioner for mounting to the host circuit board, the upper contact array including an upper front contact holder holding the upper mating beams, the upper contact array including an upper rear contact holder separate and discrete from the upper front contact holder holding the upper contact tails; and wherein the lower contacts include lower intermediate portions extending between lower mating beams and lower contact tails, the lower mating beams extending into the outer positioner card slot, the lower contact tails extending from the outer contact positioner for mounting to the host circuit board, the lower contact array including a lower front contact holder holding the lower mating beams and a lower rear contact holder separate and discrete from the lower front contact holder holding the lower contact tails.

8. The card edge connector of claim 7, wherein the upper contact array includes an upper intermediate contact holder separate and discrete from the upper front and rear contact holders holding the upper intermediate portions, and wherein the lower contact array includes a lower intermediate contact holder separate and discrete from the lower front and rear contact holders holding the lower intermediate portions.

9. The card edge connector of claim 7, wherein the upper contact array includes an upper ground plate extending along the upper contacts to provide electrical shielding for the upper contacts and the lower contact array includes a lower ground plate extending along the lower contacts to provide electrical shielding for the lower contacts.

10. The card edge connector of claim 9, wherein the upper ground plate includes ground contacts having ground tails stamped and formed from the upper ground plate, the ground tails configured to be terminated to the host circuit board.

11. The card edge connector of claim 7, wherein the upper intermediate portions include forward sections and rearward sections with bends between the forward sections and the rearward sections, the forward sections oriented perpendicular to the rearward sections, and wherein the lower intermediate portions include forward sections and rearward sections with bends between the forward sections and the rearward sections.

12. The card edge connector of claim 7, wherein the upper intermediate portions are flexible to allow relative movement of the upper front contact holder and the upper rear contact holder, the lower intermediate portions being flexible to allow relative movement of the lower front contact holder and the lower rear contact holder.

13. The card edge connector of claim 7, wherein the upper intermediate portions are exposed to air between the upper front contact holder and the upper rear contact holder, the lower intermediate portions being exposed to air between the lower front contact holder and the lower rear contact holder.

14. The card edge connector of claim 7, wherein the upper front contact holder is movable relative to the outer contact positioner and the lower front contact holder is movable relative to the outer contact positioner, the upper front contact holder engaging the housing in the cavity to position the upper front contact holder relative to the outer contact positioner and the housing to position the upper mating beams relative to the outer positioner card slot and the housing card slot for mating with the module circuit board, the lower front contact holder engaging the housing in the cavity to position the outer lower front contact holder relative to the outer contact positioner and the housing to position the lower mating beams relative to the outer positioner card slot and the housing card slot for mating with the module circuit board.

15. The card edge connector of claim 7, wherein the upper front contact holder includes an overmold body encasing each of the upper contacts, the upper rear contact holder includes an overmold body encasing each of the upper contacts, the lower front contact holder includes an overmold body encasing each of the lower contacts, the lower rear contact holder includes an overmold body encasing each of the lower contacts.

16. A stacked card edge connector for mating with stacked pluggable modules, the stacked card edge connector comprising:

a housing including a top and a bottom, the housing having a front and a rear, the housing having a first side and a second side, the bottom configured to be mounted to a host circuit board, the housing including a cavity at the rear, the housing including inner housing locating features proximate to the bottom and housing locating features proximate to the top, the housing including an inner contact channel and an outer contact channel, the inner contact channel closer to the bottom and the host circuit board, the housing including an inner card slot open to the inner contact channel at the front of the housing, the housing including an outer card slot open to the outer contact channel at the front of the housing, the inner and outer card slots configured to receive card edges of module circuit boards of the stacked pluggable modules;

an inner contact assembly received in the cavity, the inner contact assembly having an inner contact positioner holding inner contacts in an upper contact array and a lower contact array, the upper contact array including a front contact holder holding corresponding inner contacts and a rear contact holder holding corresponding inner contacts, the lower contact array including a front contact holder holding corresponding inner contacts and a rear contact holder holding corresponding inner contacts, the inner contact positioner having an upper wall and a lower wall extending between side walls of the inner contact positioner, the inner contact positioner including an inner positioner card slot defined between the upper wall and the lower wall of the inner contact positioner, the upper wall supporting the upper contact array of the inner contact assembly, the lower wall supporting the lower contact array of the inner contact array assembly, the inner contact positioner is positioned in the inner contact channel aligned with the inner card slot to receive the card edge of the module circuit board, the side walls including front slots and rear slots, the front slots receiving the front contact holder to position the inner contacts relative to the inner contact positioner, the rear slots receiving the rear contact holder to position the inner contacts relative to the inner contact positioner, the inner contact positioner including an inner locating feature engaging the inner housing locating features to position the inner contacts relative to the housing for electrical connection with the host circuit board and the corresponding pluggable module; and an outer contact assembly received in the cavity, the outer contact assembly having an outer contact positioner holding outer contacts in an upper contact array and a lower contact array, the upper contact array including a front contact holder holding corresponding outer contacts and a rear contact holder holding corresponding outer contacts, the lower contact array including a front contact holder holding corresponding outer contacts and a rear contact holder holding corresponding outer contacts, the outer contact positioner having an upper wall and a lower wall extending between side walls of the outer contact positioner, the outer contact positioner including an outer positioner card slot defined between the upper wall and the lower wall of the outer contact positioner, the upper wall supporting the upper contact array of the outer contact assembly, the lower wall supporting the lower contact array of the outer contact array assembly, the outer contact positioner is positioned in the outer contact channel aligned with the outer card slot to receive the card edge of the module circuit board, the side walls including front slots and rear slots, the front slots receiving the front contact holder to position the outer contacts relative to the outer contact positioner, the rear slots receiving the rear contact holder to position the outer contacts relative to the outer contact positioner, the outer contact positioner including an outer locating feature engaging the housing locating features to position the outer contacts relative to the housing for electrical connection with the host circuit board and the corresponding pluggable module.

17. The card edge connector of claim 16, wherein the inner contact assembly is a double-sided, multirole contact assembly and the outer contact assembly is a double-sided, multirole contact assembly.

18. The card edge connector of claim 16, wherein the outer contacts include upper contacts forming the upper contact array and lower contacts forming the lower contact array;

wherein the upper contacts include upper intermediate portions extending between upper mating beams and upper contact tails, the upper mating beams extending into the outer positioner card slot, the upper contact tails extending from the outer contact positioner for mounting to the host circuit board, the upper contact array including an upper front contact holder holding the upper mating beams, the upper contact array including an upper rear contact holder separate and discrete from the upper front contact holder holding the upper contact tails; and wherein the lower contacts include lower intermediate portions extending between lower mating beams and lower contact tails, the lower mating beams extending into the outer positioner card slot, the lower contact tails extending from the outer contact positioner for mounting to the host circuit board, the lower contact array including a lower front contact holder holding the lower mating beams and a lower rear contact holder separate and discrete from the lower front contact holder holding the lower contact tails.

19. The card edge connector of claim 18, wherein the upper contact array includes an upper intermediate contact holder separate and discrete from the upper front and rear contact holders holding the upper intermediate portions, and wherein the lower contact array includes a lower intermediate contact holder separate and discrete from the lower front and rear contact holders holding the lower intermediate portions.

20. The card edge connector of claim 18, wherein the upper contact array includes an upper ground plate extending along the upper contacts to provide electrical shielding for the upper contacts and the lower contact array includes a lower ground plate extending along the lower contacts to provide electrical shielding for the lower contacts.

21. The card edge connector of claim 20, wherein the upper ground plate includes ground contacts having ground tails stamped and formed from the upper ground plate, the ground tails configured to be terminated to the host circuit board.

22. A stacked card edge connector for mating with stacked pluggable modules, the stacked card edge connector comprising:

a housing including a top and a bottom, the housing having a front and a rear, the housing having a first side and a second side, the bottom configured to be mounted to a host circuit board, the housing including a cavity at the rear, the housing including an inner contact channel and an outer contact channel, the inner contact channel closer to the bottom and the host circuit board, the housing including an inner card slot open to the inner contact channel at the front of the housing, the housing including an outer card slot open to the outer contact channel at the front of the housing, the inner and outer card slots configured to receive card edges of module circuit boards of the stacked pluggable modules;

an inner contact assembly received in the cavity, the inner contact assembly having an inner contact positioner holding inner contacts in an upper contact array and a lower contact array, the inner contact positioner having an upper wall and a lower wall with an inner positioner card slot defined therebetween, the upper wall supporting the upper contact array of the inner contact assembly, the lower wall supporting the lower contact array of the inner contact array assembly, the inner contact positioner is positioned in the inner contact channel aligned with the inner card slot to receive the card edge of the module circuit board, the inner contact positioner including an inner locating feature engaging the housing to position the inner contacts relative to the housing for electrical connection with the host circuit board and the corresponding pluggable module; and an outer contact assembly received in the cavity, the outer contact assembly having an outer contact positioner holding outer contacts, the outer contacts including upper contacts in an upper contact array and lower contacts in a lower contact array, the outer contact positioner having an upper wall and a lower wall with an outer positioner card slot defined therebetween, the upper wall supporting the upper contact array of the outer contact assembly, the lower wall supporting the lower contact array of the outer contact array assembly, the outer contact positioner is positioned in the outer contact channel aligned with the outer card slot to receive the card edge of the module circuit board, the outer contact positioner including an outer locating feature engaging the housing to position the outer contacts relative to the housing for electrical connection with the host circuit board and the corresponding pluggable module;

wherein the upper contacts include upper intermediate portions extending between upper mating beams and upper contact tails, the upper mating beams extending into the outer positioner card slot, the upper contact tails extending from the outer contact positioner for mounting to the host circuit board, the upper contact array including an upper front contact holder holding the upper mating beams, the upper contact array including an upper rear contact holder separate and discrete from the upper front contact holder holding the upper contact tails, the upper contact array including an upper intermediate contact holder separate and discrete from the upper front and rear contact holders holding the upper intermediate portions; and wherein the lower contacts include lower intermediate portions extending between lower mating beams and lower contact tails, the lower mating beams extending into the outer positioner card slot, the lower contact tails extending from the outer contact positioner for mounting to the host circuit board, the lower contact array including a lower front contact holder holding the lower mating beams and a lower rear contact holder separate and discrete from the lower front contact holder holding the lower contact tails, the lower contact array including a lower intermediate contact holder separate and discrete from the lower front and rear contact holders holding the lower intermediate portions.

* * * * *